US006943737B2

(12) United States Patent
Ryken et al.

(10) Patent No.: US 6,943,737 B2
(45) Date of Patent: Sep. 13, 2005

(54) GPS MICROSTRIP ANTENNA

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/817,409

(22) Filed: Mar. 31, 2004

(65) Prior Publication Data

US 2005/0057398 A1 Mar. 17, 2005

Related U.S. Application Data

(63) Continuation-in-part of application No. 10/648,715, filed on Aug. 23, 2003, now Pat. No. 6,867,737.

(51) Int. Cl.[7] ..... H01Q 1/38
(52) U.S. Cl. ..... 343/700 MS; 343/853
(58) Field of Search ..... 343/700 MS, 846, 343/850, 853

(56) References Cited

U.S. PATENT DOCUMENTS

| | | | | |
|---|---|---|---|---|
| 6,795,021 | B2 * | 9/2004 | Ngai et al. | 343/700 MS |
| 6,847,328 | B1 * | 1/2005 | Libonati et al. | 343/700 MS |
| 6,867,737 | B1 * | 3/2005 | Ryken, Jr. et al. | 343/700 MS |
| 2004/0090368 | A1 * | 5/2004 | Channabasappa et al. | 343/700 MS |

* cited by examiner

*Primary Examiner*—Shih-Chao Chen
(74) *Attorney, Agent, or Firm*—David S. Kalmbaugh

(57) ABSTRACT

A GPS microstrip antenna designed to receive satellite provided GPS position for use by a nine inch diameter projectile. The GPS microstrip antenna is configured to wrap around the projectile's body without interfering with the aerodynamic design of the projectile. The GPS microstrip antenna operates at 1.575 GHz with a bandwidth of ±10 MHz. Eight microstrip antenna elements equally spaced around the projectile provide for circular polarization and a quasi-omni directional radiation pattern.

20 Claims, 6 Drawing Sheets

GPS MICROSTRIP ANTENNA

This application is a continuation-in-part of U.S. patent application Ser. No. 10/648,715, filed Aug. 27, 2003, now U.S. Pat. No. 6,867,737.

BACKGROUND OF THE INVENTION

1. Field of the Invention

The present invention relates generally to a microstrip antenna for use on a missile or the like. More specifically, the present invention relates to a microstrip antenna which receives GPS (global positioning system) data and which is adapted for use on small diameter projectiles such as a missile.

2. Description of the Prior Art

A microstrip antenna operates by resonating at a frequency. The conventional design for a MICROSTRIP antenna utilizes printed circuit board techniques mounting a copper patch on the top layer of a dielectric with a ground plane on the bottom of the dielectric. The frequency at which the antenna operates is approximately a half wavelength in the microstrip medium of dielectric below the copper patch and air above the copper patch.

However, there is a need to isolate the microstrip antenna from radio frequency signals at different frequencies than the operating frequency for the antenna. There is also a need to protect the antenna and to provide for signal amplification.

To achieve isolation, protection and amplification, prior art microstrip antenna designs have used an external filter, an external amplifier with a built-in limiter or an external limiter. All of these external components require extra space, which is generally not available on weapons systems, such as small diameter projectiles, and also require interconnecting coaxial cables, which are expensive and not practical when there are severe limitations on available apace in weapons systems.

Accordingly, there is a need for a microstrip antenna which operates in the GPS frequency band, requires minimal space, and provides for isolation, protection and amplification. More specifically, there is a need for a GPS frequency band microstrip antenna which generates an omni-directional antenna pattern, provides for a 25 dB minimum amplification with amplifier protection and has 30 dB isolation from a frequency of 2 GHz to a frequency of 7 GHz.

SUMMARY OF THE INVENTION

The present invention overcomes some of the disadvantages of the past including those mentioned above in that it comprises a highly effective and efficient microstrip antenna designed to receive satellite provided GPS position for use by an approximately nine inch diameter projectile. The microstrip antenna comprising the present invention is configured to wrap around the projectile's body without interfering with the aerodynamic design of the projectile.

The GPS microstrip antenna operates at 1.575 GHz with a bandwidth of ±10 MHz. Eight microstrip antenna elements equally spaced around the projectile provide for circular polarization and a quasi-omni directional radiation pattern. The eight antenna elements are positioned at a 45 degree angle to reduce the effect of gain variance versus roll of the projectile.

There is a gap around each of the eight antenna elements with the remainder of the antenna covered with copper. The antenna element's electric field is confined generally to the gap. Circular polarization is achieved by feeding each antenna element with two orthoginal probes connected to the antennas feed network.

A limiter and amplifier are also connected to the antenna's feed network and provide an overall gain of approximately 27 dB with a maximum noise figure of 1.2 dB.

The feed network consist of equal phase and amplitude power dividers. The feed network also has two identical filters with each filter including a band stop filter and a low pass filter. The combination of the band stop filter and the low pass filter isolates GPS radio frequency signals from TM band signals over a frequency range from 2 to 7 GHz with a minimal loss in the GPS pass band.

DETAILED DESCRIPTION OF A PREFERRED EMBODIMENT

Figure 1A:
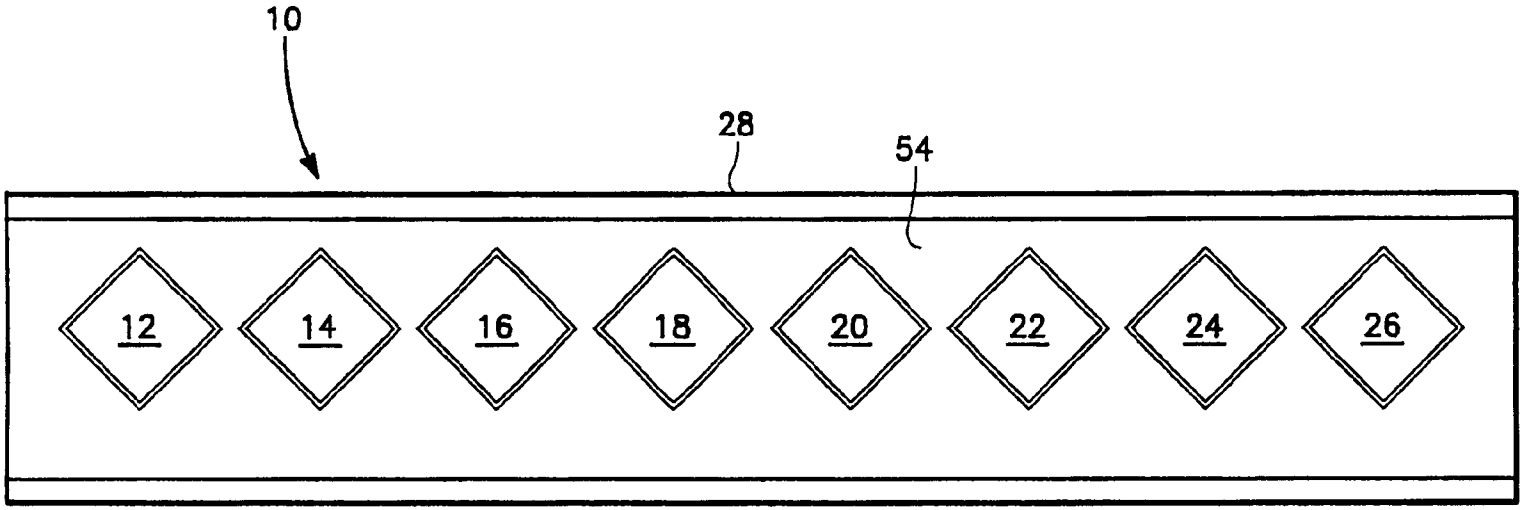
FIG. 1A is a view illustrating the top layer of a circuit board for the GPS microstrip antenna comprising the present invention.
Figure 2:
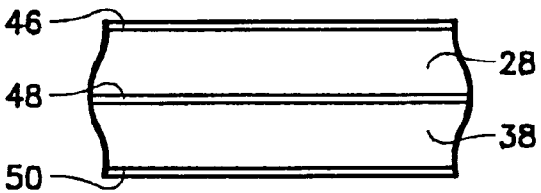
FIG. 2 is a side view of the circuit and ground broads for the GPS microstrip antenna of FIG. 1A.
Figure 1B:
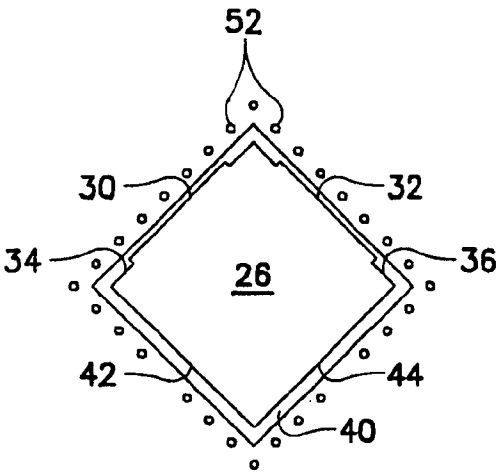
FIG. 1B is an enlarged view depicting one of the eight antenna elements of FIG. 1A including the tuning tabs for the antenna element.

Referring to FIGS. 1A, 1B and 2, there is shown a GPS (Global Positioning System) antenna 10 which is a wrap around antenna designed for a small projectile of having a diameter approximately of nine inches. Antenna 10 operates at the GPS L1 Band centered at 1.575 GHz with a bandwidth of ±10 MHz. Antenna 10 is circularly polarized and provides for quasi-omni directional radiation pattern coverage.

Referring to FIGS. 1A and 2, microstrip antenna 10 includes eight microstrip antenna elements or rectangular shaped (approximating a square) copper patches 12, 14, 16, 18, 20, 22, 24 and 26 which are equally spaced apart and mounted on a circuit board 28. The eight microstrip antenna elements 12, 14, 16, 18, 20, 22, 24 and 26 are positioned around the outer diameter of a nine inch projectile when microstrip antenna 10 is affixed to the projectile. The eight antenna elements 12, 14, 16, 18, 20, 22, 24 and 26 are positioned on the circuit board 28 at a forty five degree angle to reduce the effect of gain variations versus roll of the projectile when compared to antenna elements positioned at zero degrees.

Referring to FIGS. 1A and 1B, each of the eight antenna elements 12, 14, 16, 18, 20, 22, 24 and 26 has a pair of tuning stubs 30 and 32 on the upper left side 34 and the upper right side 36, respectively. The tuning stubs 30 and 32 for each antenna element 12, 14, 16, 18, 20, 22, 24 and 26 are provided to compensate for manufacturing tolerances and allow for fine tuning of each of the eight antenna elements 12, 14, 16, 18, 20, 22, 24 and 26 to the operating frequency for microstrip antenna 10 over approximately 10 MHz.

At this time, it should be noted that the circuit board 28 and a ground board 38 which is positioned below the circuit board 28 are each fabricated from a dielectric. The dielectric used in the preferred embodiment is Duroid 6002 commercially available from Rogers Corporation of Rogers, Conn. The top layer and bottom layer of the circuit board and the bottom layer of the ground board respectively have a one ounce copper plating 46, 48 and 50 with a 0.0014 inch thickness that is etched off to provide the antenna element, feed network and ground patterns illustrated in FIGS. 1A, 3 and 4. The circuit board 28 and the ground board 38 each have overall dimensions of 5.7 inches in width and approximately 27 inches in length.

There is also a four sided gap 40 formed around each side 34, 36, 42 and 44 of the eight antenna elements 12, 14, 16, 18, 20, 22, 24 and 26 of microstrip antenna 10. The four sided gap 40 exposes the top surface of the dielectric 28. The microstrip antenna's electric field is confined primarily to the four sided gap 40 around each of the antenna elements which is substantial different than a conventional microstrip copper antenna element where the electric field extends well beyond the antenna element.

Figure 3:
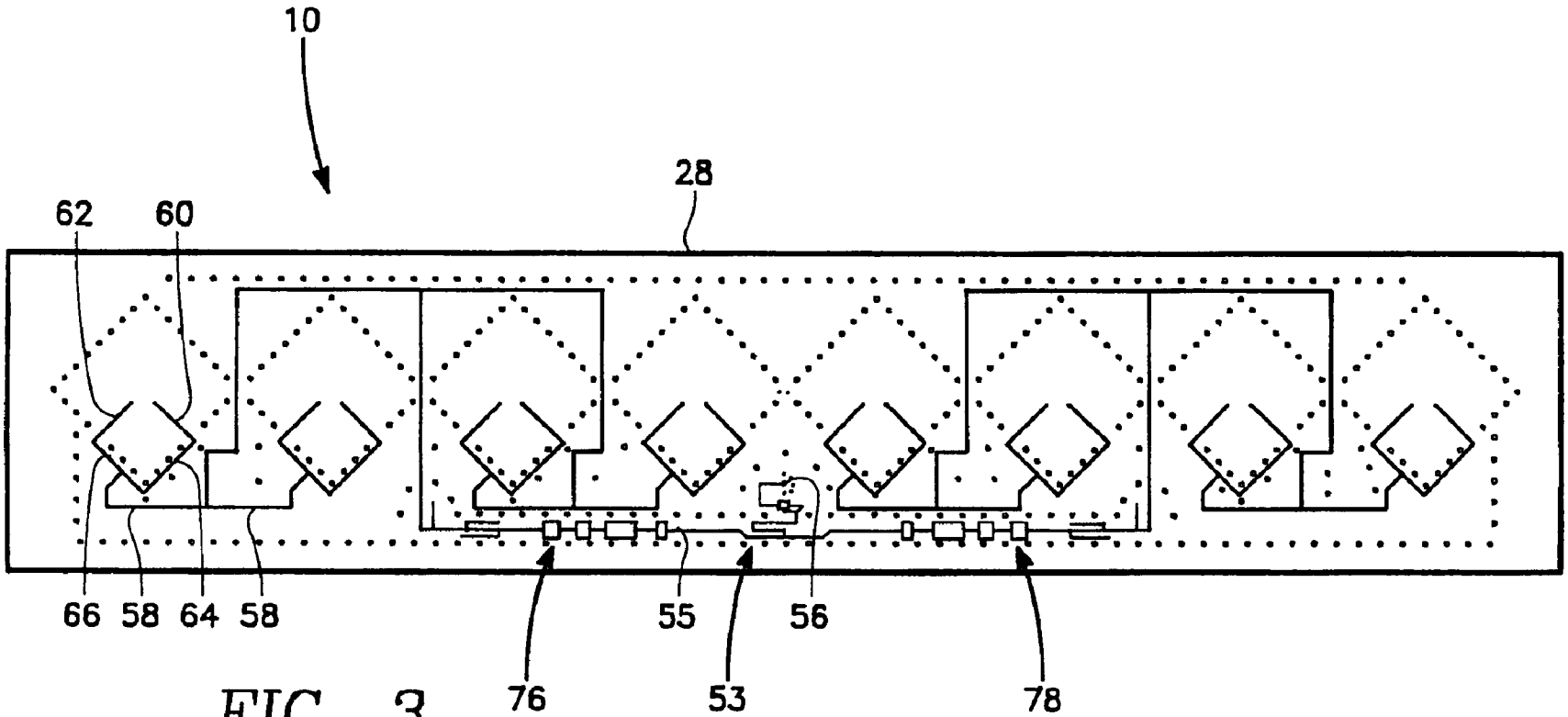
FIG. 3 is a view illustrating the bottom layer of the circuit board for the GPS antenna of FIG. 1A.

Referring to FIGS. 1A and 3, each of the antenna elements 12, 14, 16, 18, 20, 22, 24 and 26 is capacitively coupled to a feed network 53 which includes a main transmission line 55, fabricated from etched copper, having one of its ends connected to a fifty ohm signal output 56 for microstrip antenna 10. The feed network 53 operates as an equal amplitude, equal phase power divider providing for equal distribution of RF signals with respect to the eight antenna elements 12, 14, 16, 18, 20, 22, 24, and 26 in both amplitude and phase.

The feed network 53 also includes a plurality of branch transmission lines 58, fabricated from etched copper, which connect the main transmission line 55 to the eight antenna elements 12, 14, 16, 18, 20, 22, 24, and 26. Each antenna element 12, 14, 16, 18, 20, 22, 24 and 28 is cpacitively coupled to one of the branch transmission lines 58 of feed network 53 by a pair of probes 60 and 62 which are also etched copper transmission lines. The probes 60 and 62 are positioned perpendicular to one another directly underneath each antenna element 12, 14, 16, 18, 20, 22, 24, and 26 and terminate below each antenna element 12, 14, 16, 18, 20, 22, 24 and 26. The feed line 64 to probe 60 is substantially longer than the feed line 66 to probe 62 to provide for two orthogonal modes for each antenna element at a ninety degree relative phase shift resulting in right hand circular polarization for the antenna elements of microstrip antenna 10. Capacitive coupling of the RF signals from the eight antenna elements 12, 14, 16, 18, 20, 22, 24 and 26 to their associated probes 60 and 62 is through the dielectric layer 28.

At this time it should be noted that the main feed line 53, branch feed lines 58 and probes 60 and 62 are configured such that feed network 53 operates as equal amplitude, equal phase power dividers.

Figure 4:
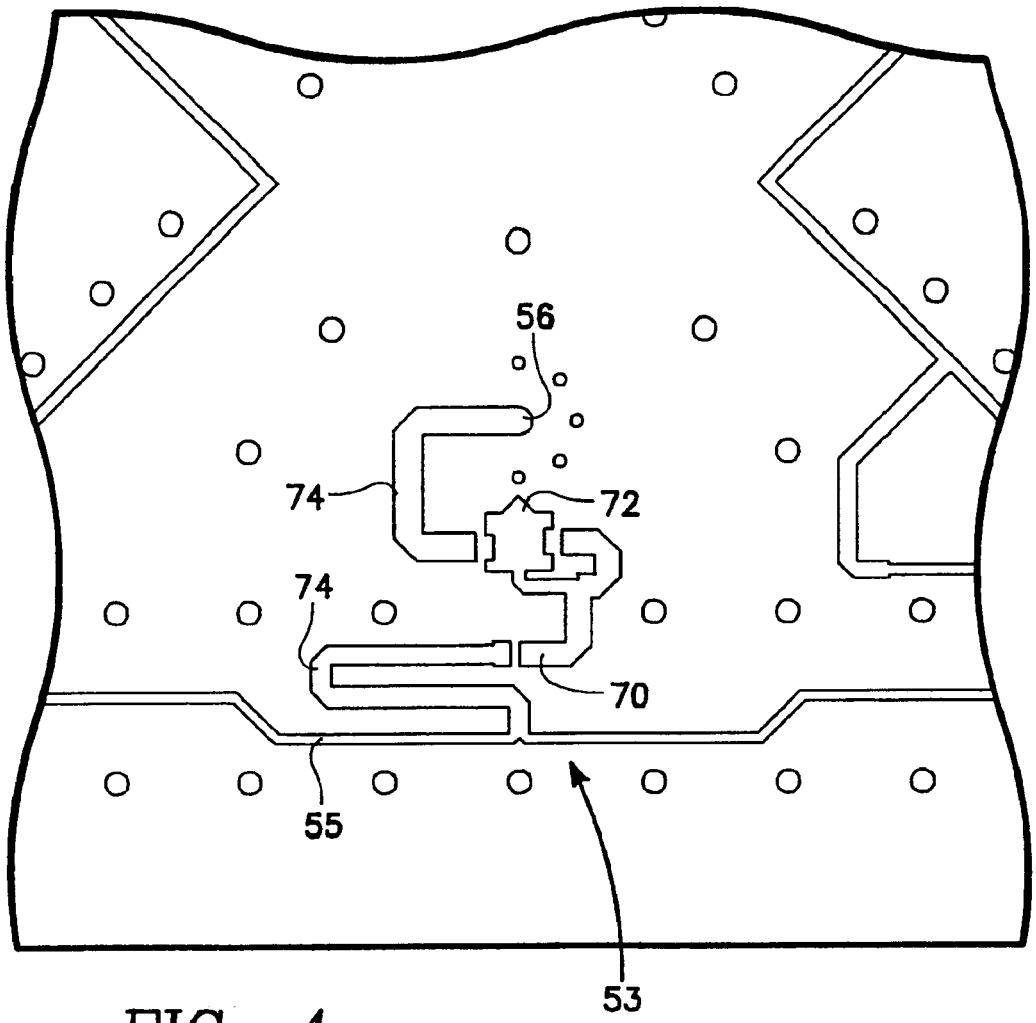
FIG. 4 is an enlarged view of a section of the feed network on the bottom layer of the circuit board including a limiter and an amplifier used in the preferred embodiment of the GPS microstrip antenna of FIG. 1A.

Referring now to FIGS. 3 and 4, there is an enlarged view of a centrally located section of feed network 53 which includes a limiter 70 and an amplifier 72 connected to a copper transmission line 74. The copper transmission line 74 the main transmission line 55 to the fifty ohm signal output 56 for microstrip antenna 10. The overall gain of the combination of limiter 70 and amplifier 72 is approximately 27 dB with a maximum noise level of 1.2 dB. Limiter 70 has shown the ability to stand off eight to ten watts of CW input power when used as a limiter. Amplifier 72 is a low noise amplifier, having high gain, high dynamic range and low power consumption characteristics.

The limiter used in the preferred embodiment is an Agilent HSMP-4820 Surface Mount RF PIN Limiter Diode in an SOT-23 package, commercially available from Agilent Technologies of Palo Alto, Calif. The amplifier used in the preferred embodiment is an M/A-Com AM50-0002 low noise amplifier, commercially available from Tyco Electronics, a division of Tyco International of Waltham, Mass.

Figure 5:
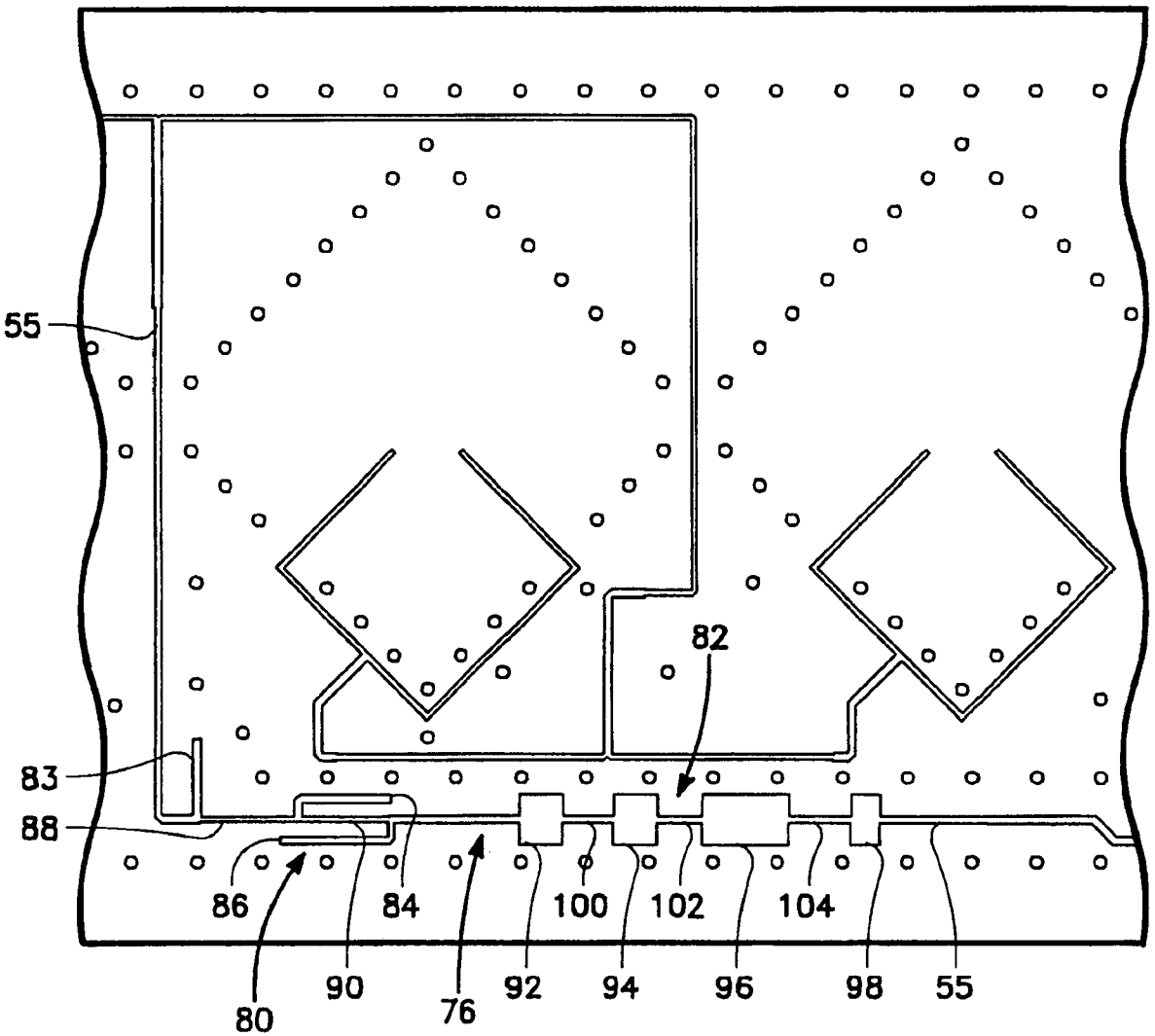
FIG. 5 is an enlarged view of another section of the feed network on the bottom layer of the circuit board which includes one of two identical filters used in the preferred embodiment of the GPS microstrip antenna of FIG. 1A.

Referring to FIGS. 3 and 5, FIG. 5 is an enlarged view of a section on the left side of the feed network 53 illustrating in detail a filter 76 which is one of two identical filters 76 and 78 used in the preferred embodiment of the GPS microstrip antenna 10. The other filter 78 is positioned on the right side of the circuit board 28 as shown in FIG. 3.

Each filter 76 and 78 comprises a 5-Section Band Stop Filter 80 and a 7-Section Low Pass Filter 82. The combination of filter 80 and filter 82 are designed to obtain an isolation from 2 to 7 GHz with a minimal loss in the GPS pass band. This isolation includes the S-Band Telemetry Frequency which has a center frequency of approximately 2.25 GHz and a bandwidth of ±10 MHz.

Band stop filter 80 includes 3 open circuit transmission lines 83, 84 and 86 and two interconnecting transmission lines 88 and 90 which form the five sections of the filter 80. Low Pass Filter 82 includes four rectangular shaped filter elements 92, 94, 96 and 98 and three interconnecting lines 100, 102 and 104. Each filter 80 and 82 is connected to the main transmission line 55 for feed network 53. Band Stop filter 80 is a very efficient in rejecting signals in the TM frequency range of 2.2–2.3 GHz. Low pass filter 82 provides minimal loss up to approximately 2 GHz. The combination of filters 80 and 82 filtering out unwanted RF signals between 2 and 7 GHz.

Figure 6:
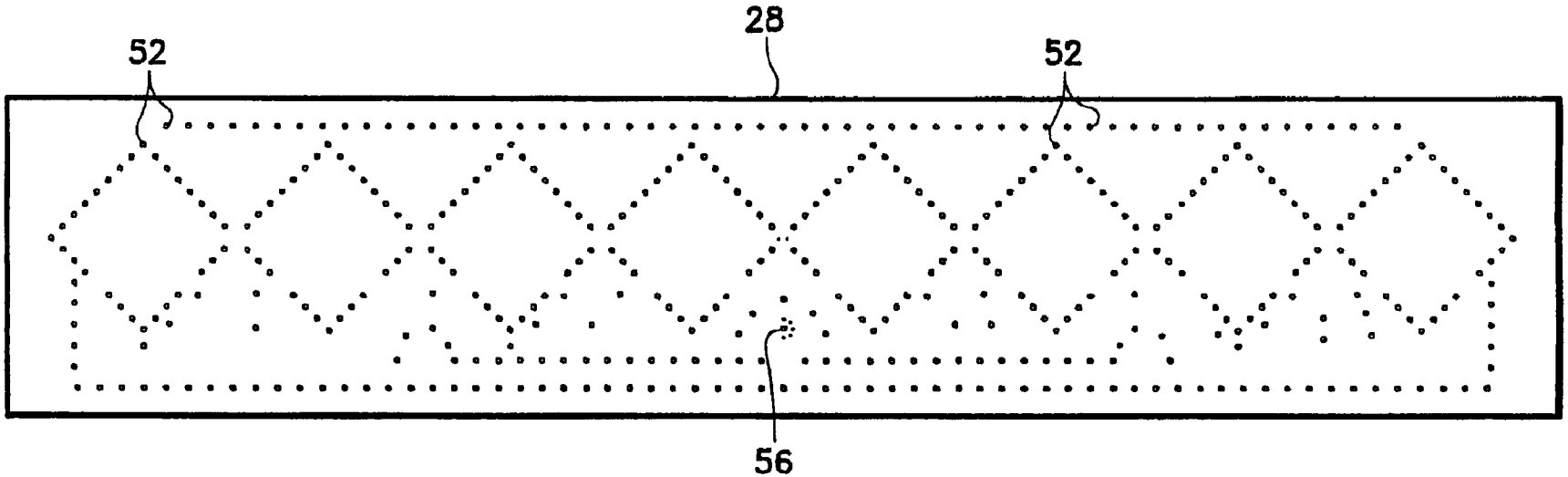
FIG. 6 depicts the layout for the vias/copper plated through holes of the circuit board of FIGS. 1A.
Figure 7:
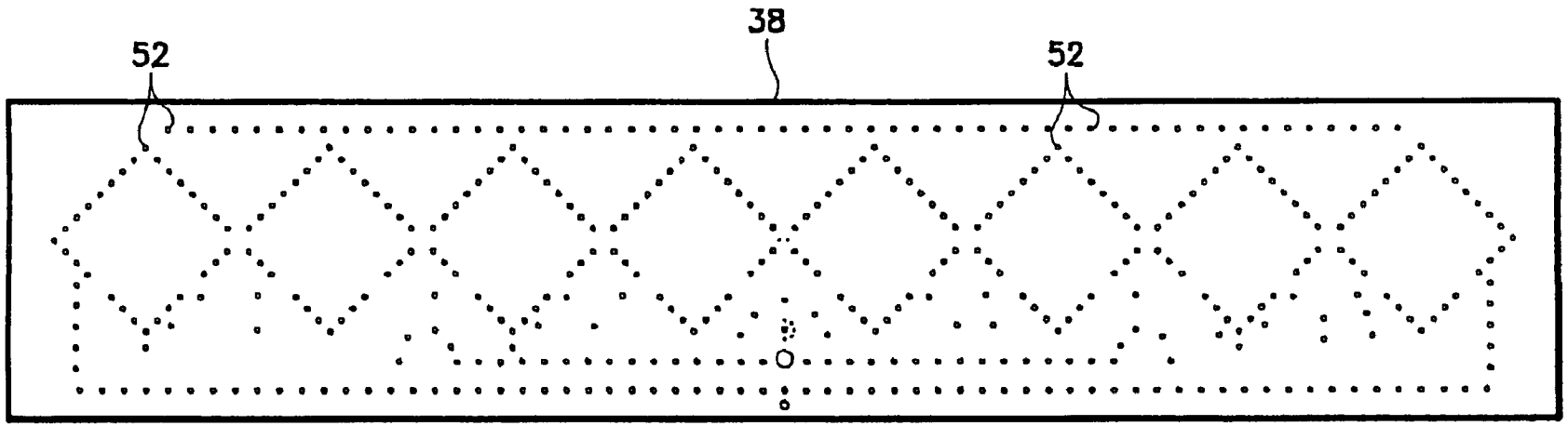
FIG. 7 depicts the top layer of the ground board for the the GPS microstrip antenna comprising the present invention.

Referring to FIGS. 1A, 6 and 7, microstrip antenna 10 includes a plurality of plated through holes/vias 52 with the layout for the vias 52 in circuit board 28 being depicted as shown in FIG. 6 and the layout for the vias 52 in ground board 38 being depicted in FIG. 7. The copper region 54 around each of the antenna elements 12, 14, 16, 18, 20, 22, 24 and 26 is maintained at a ground potential by the vias or copper plated through holes 52. Each of the vias 52 passes through the circuit board 28 and the ground board 38 to the copper plated ground plane 50 on the bottom surface of ground board 38. The vias 52 electrically connect the copper region 54 of circuit board 28 to the ground plane 50 of ground board 38.

From the foregoing, it is readily apparent that the present invention comprises a new, unique, and exceedingly useful GPS microstrip antenna adapted for use on small diameter projectiles, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A GPS (Global Positioning System) microstrip antenna mounted on a projectile comprising:

(a) a first rectangular shaped dielectric layer;

(b) a plurality of square shaped antenna elements mounted on an upper surface of said first dielectric layer, said antenna elements being aligned with one another and fabricated from copper, each of said antenna elements being positioned at an angle of approximately forty five degrees on said first dielectric layer, said antenna elements being adapted to receive GPS (Global Positioning System) data at a frequency of approximately 1.575 GHz;

(c) an antenna feed network mounted on a bottom surface of said first dielectric layer, said antenna feed network having a main transmission line connected to a signal output for said GPS microstrip antenna, said feed network having a plurality of branch transmission lines connected to said main transmission line and each of said antenna elements, each of said branch transmission lines including a pair of probes positioned perpendicular to one another underneath one antenna element of said plurality of antenna elements, one of said pair of probes for each of said branch transmission lines having a length substantially greater than the other of said pair of probes for each of said branch transmission lines to provide for a ninety degree relative phase shift between RF signals transmitted through said pair of probes for each of said pair of branch transmission lines resulting in a circular polarization and an omni-directional radiation pattern being generated by said antenna elements of said GPS microstrip antenna;

(d) a pair of identical filters integrally formed within said main transmission line, said pair of identical filters isolating GPS radio frequency signals from TM band signals over a frequency range from about 2 GHz to about 7 GHz;

(e) a diode limiter connected to said main transmission line in proximity to said signal output for said feed network; and (f) an amplifier connected to said main transmission line in proximity to said signal output for said feed network, said diode limiter and said amplifier providing for an overall gain of approximately 27 decibels.

2. The GPS microstrip antenna of claim 1 further comprising a continuous gap formed around first, second, third and fourth sides of each of said antenna elements, said continuous gap for each of said antenna elements having an electric field generated by said antenna element confined to said continuous gap.

3. The GPS microstrip antenna of claim 2 further comprising a copper plated ground mounted on a remaining portion of the upper surface of said first dielectric layer around the continuous gap for each of said antenna elements.

4. The GPS microstrip antenna of claim 3 further comprising a second dielectric layer positioned below said first dielectric layer in alignment with said first dielectric layer, said second dielectric having a ground plane mounted on a bottom surface thereof.

5. The GPS microstrip antenna of claim 4 wherein said copper plated ground mounted on the upper surface of said first dielectric layer is connected to the ground plane mounted on the bottom surface of said second dielectric layer by a plurality of vias which pass from said copper plated ground through said first dielectric layer and said second dielectric layer to said ground plane.

6. The GPS microstrip antenna of claim 1 wherein said pair of identical filters each comprise a 5-Section Band Stop Filter and a 7-Section Low Pass Filter.

7. The GPS microstrip antenna of claim 1 wherein each of said antenna elements includes a pair of tuning stubs located on adjacent sides of said antenna element, said pair of tuning stubs for each of said antenna elements allowing said antenna elements to be fine tuned to an operating frequency for said GPS microstrip antenna.

8. The GPS microstrip antenna of claim 1 wherein said signal output for said feed network comprises a fifty ohm signal output for said feed network.

9. The GPS microstrip antenna of claim 4 wherein said first dielectric layer comprises a circuit board and said second dielectric layer comprises a ground board, said circuit board and said-ground board each having an overall dimension of 5.7 inches in width and approximately 27 inches in length.

10. A GPS (Global Positioning System) microstrip antenna mounted on a projectile comprising:

(a) a first rectangular shaped dielectric layer;

(b) a plurality of square shaped antenna elements mounted on an upper surface of said first dielectric layer, said plurality of antenna elements being aligned with one another and fabricated from copper, each of said plurality of antenna elements being positioned at an angle of approximately forty five degrees on said first dielectric layer, said plurality of antenna elements being adapted to receive GPS (Global Positioning System) data at a frequency of approximately 1.575 GHz;

(c) each of said plurality of antenna elements including a pair of tuning stubs located on adjacent sides of said antenna element, said pair of tuning stubs for each of said plurality of antenna elements allowing said plurality of antenna elements to be fine tuned to an operating frequency for said GPS microstrip antenna;

(d) an antenna feed network mounted on a bottom surface of said first dielectric layer, said antenna feed network having a main transmission line connected to a signal output for said GPS microstrip antenna, said feed network having a plurality of branch transmission lines connected to said main transmission line at one end thereof, the opposite end of each of said branch transmission lines including a pair of probes positioned perpendicular to one another underneath one antenna element of said plurality of antenna elements, one of said pair of probes for each of said branch transmission lines having a length substantially greater than the other of said pair of probes for each of said branch transmission lines to provide for a ninety degree relative phase shift between RF signals transmitted through said pair of probes for each of said pair of branch transmission lines resulting in a circular polarization and an omni-directional radiation pattern being generated by said plurality of antenna elements of said GPS microstrip antenna;

(e) a pair of identical filters integrally-formed within said main transmission line, said pair of identical filters isolating GPS radio frequency signals from TM band signals over a frequency range from about 2 GHz to about 7 GHz, each of said pair of filters including a low pass filter and a band stop filter;

(f) a diode limiter connected to said main transmission line in proximity to said signal output for said feed network;

(g) an amplifier connected to said main transmission line in proximity to said signal output for said feed network, said diode limiter and said amplifier providing for an overall gain of approximately 27 decibels; and (h) a second dielectric layer positioned below said first dielectric layer in alignment with said first dielectric layer, said second dielectric layer having a ground plane mounted on a bottom surface thereof.

11. The GPS microstrip antenna of claim 10 further comprising a continuous gap formed around first, second, third and fourth sides of each of said plurality of antenna elements, said continuous gap for each of said plurality of antenna elements having an electric field generated by said antenna element confined to said continuous gap.

12. The GPS microstrip antenna of claim 11 further comprising a copper plated ground mounted on a remaining portion of the upper surface of said first dielectric layer around the continuous gap for each of said plurality of antenna elements.

13. The GPS microstrip antenna of claim 12 wherein said copper plated ground mounted on the upper surface of said first dielectric layer is connected to the ground plane mounted on the bottom surface of said second dielectric layer by a plurality of vias which pass from said copper plated ground through said first dielectric layer and said second dielectric layer to said ground plane.

14. The GPS microstrip antenna of claim 10 wherein said band stop filter for each of said pair of identical filters comprises a 5-Section Band Stop Filter and said low pass filter for each of said pair of identical filters comprises a 7-Section Low Pass Filter.

15. The GPS microstrip antenna of claim 10 wherein said signal output for said feed network comprises a fifty ohm signal output for said feed network.

16. The GPS microstrip antenna of claim 10 wherein said first dielectric layer comprises a circuit board and said second dielectric layer comprises a ground board, said circuit board and said ground board each having an overall dimension of 5.7 inches in width and approximately 27 inches in length.

17. A GPS (Global Positioning System) microstrip antenna mounted on a projectile comprising:

(a) a first rectangular shaped dielectric layer;

(b) eight square shaped antenna elements mounted on an upper surface of said first dielectric layer, said eight antenna elements being aligned with one another and fabricated from copper, each of said eight antenna elements being positioned at an angle of approximately forty five degrees on said first dielectric layer, said eight antenna elements being adapted to receive GPS (Global Positioning System) data at a frequency of approximately 1.575 GHz;

(d) each of said eight antenna elements including a pair of tuning stubs located on adjacent sides of said antenna element, said pair of tuning stubs for each of said eight antenna elements allowing said eight antenna elements to be fine tuned to an operating frequency for said GPS microstrip antenna;

(e) an antenna feed network mounted on a bottom surface of said first dielectric layer, said antenna feed network having a main transmission line connected to a signal output for said GPS microstrip antenna, said feed network having a plurality of branch transmission lines connected to said main transmission line at one end thereof, the opposite end of each of said branch transmission lines including a pair of probes positioned perpendicular to one another underneath one antenna element of said eight antenna elements, one of said pair of probes for each of said branch transmission lines having a length substantially greater than the other of said pair of probes for each of said branch transmission lines to provide for a ninety degree relative phase shift between RF signals transmitted through said pair of probes for each of said pair of branch transmission lines resulting in a circular polarization and an omni-directional radiation pattern being generated by said eight antenna elements of said GPS microstrip antenna;

(f) a pair of identical filters integrally formed within said main transmission line, said pair of filters isolating GPS radio frequency signals from TM band signals over a frequency range from about 2 GHz to about 7 GHz, each of said pair of filters including a 7-section low pass filter and a 5-section band stop filter;

(g) a diode limiter connected to said main transmission line in proximity to said signal output for said feed network;

(h) an amplifier connected to said main transmission line in proximity to said signal output for said feed network, said diode limiter and said amplifier providing for an overall gain of approximately 27 decibels; and (i) a second dielectric layer positioned below said first dielectric layer in alignment with said first dielectric layer, said second dielectric layer having a ground plane mounted on a bottom surface thereof.

18. The GPS microstrip antenna of claim 17 further comprising a continuous gap formed around first, second, third and fourth sides of each of said eight antenna elements, said continuous gap for each of said eight antenna elements having an electric field generated by said antenna element confined to said continuous gap.

19. The GPS microstrip antenna of claim 18 further comprising a copper plated ground mounted on a remaining portion of the upper surface of said first dielectric layer around the continuous gap for each of said plurality of antenna elements.

20. The GPS microstrip antenna of claim 19 wherein said copper plated ground mounted on the upper surface of said first dielectric layer is connected to the ground plane mounted on the bottom surface of said second dielectric layer by a plurality of vias which pass from said copper plated ground through said first dielectric layer and said second dielectric layer to said ground plane.

* * * * *